United States Patent [19]

Schrimper et al.

[11] 3,938,732

[45] Feb. 17, 1976

[54] ADJUSTMENT MEANS FOR ROLL CRUSHERS WITH GAS HYDRAULIC SPRINGS

[75] Inventors: Vernon L. Schrimper; Floyd A. Lillig; Darrell J. Ulch, all of Cedar Rapids, Iowa

[73] Assignee: Iowa Manufacturing Company, Cedar Rapids, Iowa

[22] Filed: Sept. 16, 1974

[21] Appl. No.: 506,349

[52] U.S. Cl. ..... 241/231

[51] Int. Cl.[2] ..... B02C 4/32

[58] Field of Search ..... 241/32, 230, 231, 234, 241/259.1, 290

[56] References Cited

UNITED STATES PATENTS

| | | | |
|---|---|---|---|
| 2,947,485 | 8/1960 | Woodruff et al. | 241/259.2 X |
| 3,099,406 | 7/1963 | Kautz | 241/32 |
| 3,212,721 | 10/1965 | Asplund et al. | 241/259.2 X |
| 3,315,902 | 4/1967 | Pollitz | 241/231 |
| 3,417,928 | 12/1968 | Gundlach | 241/231 X |

*Primary Examiner*—Granville Y. Custer, Jr.
*Assistant Examiner*—Howard N. Goldberg
*Attorney, Agent, or Firm*—Haven E. Simmons; James C. Nemmers

[57] ABSTRACT

A roll crusher incorporates gas hydraulic springs to maintain the desired spacing between the crushing rolls and to provide overload protection. Featured are separate hydraulic means for backing off and then re-applying the hydraulic springs by altering their overall lengths so that roll spacing can be readily adjusted.

10 Claims, 6 Drawing Figures

ADJUSTMENT MEANS FOR ROLL CRUSHERS WITH GAS HYDRAULIC SPRINGS

BACKGROUND OF THE INVENTION

U.S. Pat. 3,315,902 to Pollitz discloses the use of gas hydraulic springs in roll crushers to maintain the desired spacing between the rolls and to provide overload protection by resiliently increasing that spacing in the event of passage of uncrushable material between the rolls. The many advantages of such springs are set forth in that patent and need not be repeated here. Adjustment of the spacing between the rolls, however, still requires that the snub bolts or their equivalents used with the Pollitz springs be backed off to release the pressure on the movable roll and that the latter be manually moved bodily, usually with pry-bars. Not only is that not physically easy to do, but it is also time-consuming particularly from the standpoint of crusher down-time. It is thus the primary object of the present invention to provide an arrangement for roll crushers which retains all the advantages of the gas hydraulic springs and at the same time greatly eases the effort and time necessary to adjust the spacing between the rolls.

SUMMARY OF THE INVENTION

Essentially, the object of the invention is achieved by anchoring the piston rods of the Pollitz gas springs to the crusher frame and their cylinders to the movable roll and then modifying the springs by inserting hydraulic oil not only between the main and floating pistons, as in the Pollitz patent, but also between the main pistons and the cylinder end caps through which the piston rods operate. A hydraulic system is used to vary conjointly the volumes of the oil on both sides of the main pistons, whereby the overall length of the spring assemblies can be altered wholly independently of the pressurized gas. Thus not only can the pressure on the movable roll be instantly relieved but the latter can be easily and quickly moved one way or the other for adjustment of roll spacing since the movable roll is attached to the spring cylinders and moves with them as the overall length of the spring assemblies changes. Other and further features and advantages of the present invention will appear from the detailed description which follows and the accompanying drawings.

DETAILED DESCRIPTION OF THE PREFERRED EMBODIMENT

Inasmuch as the basic structure and operation of roll crushers are well known in the art, no extensive description or illustration of them is necessary in order for the present invention to be adequately set forth. Hence, this description and the drawings are confined primarily to the details of the modified gas hydraulic springs and only incidently to the roll crusher itself.

Figure 1:
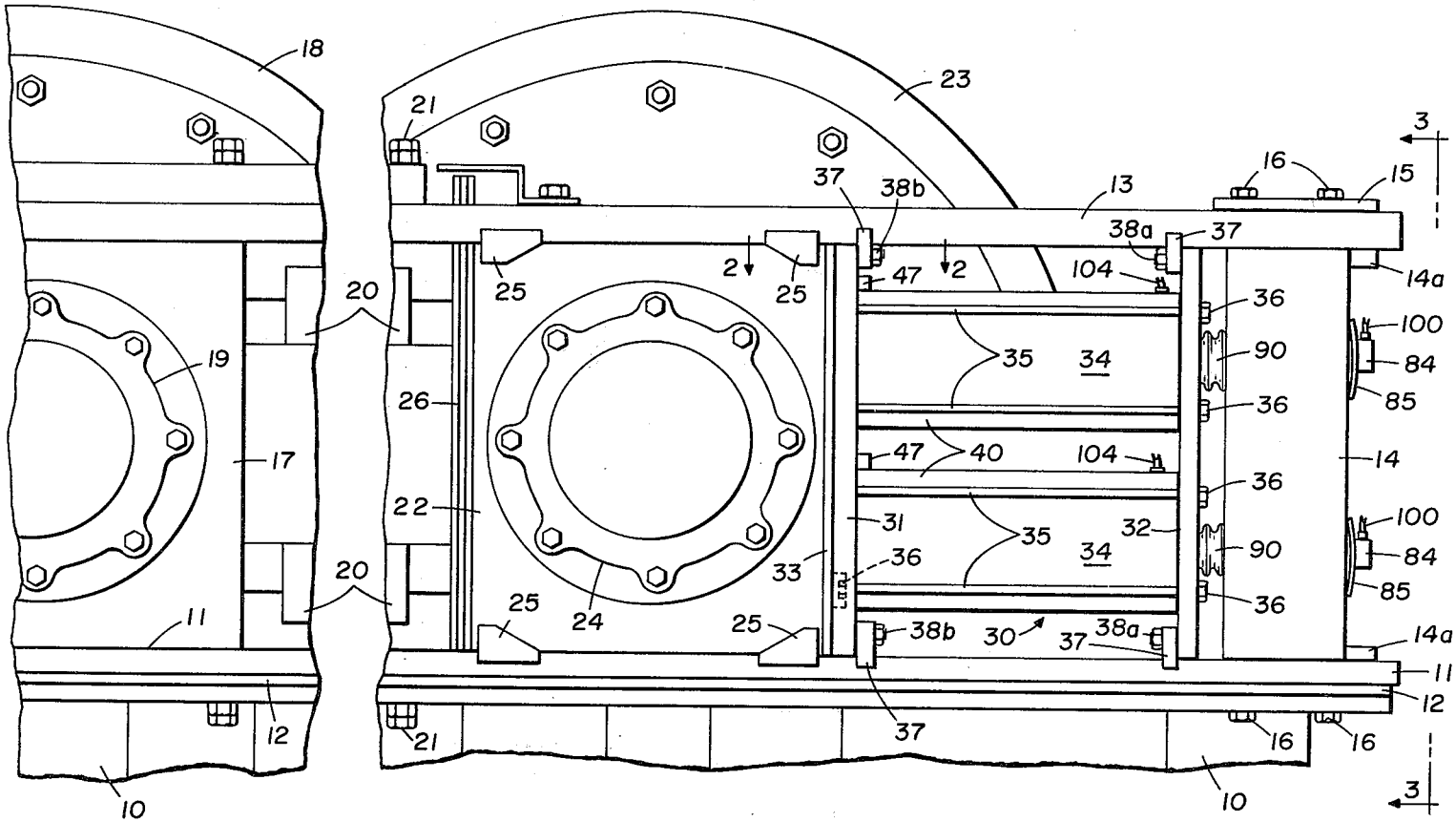
FIG. 1 is a partial side elevational view of a typical roll type crusher showing one of the modified gas hydraulic spring assemblies of the present invention installed thereon.
Figure 2:
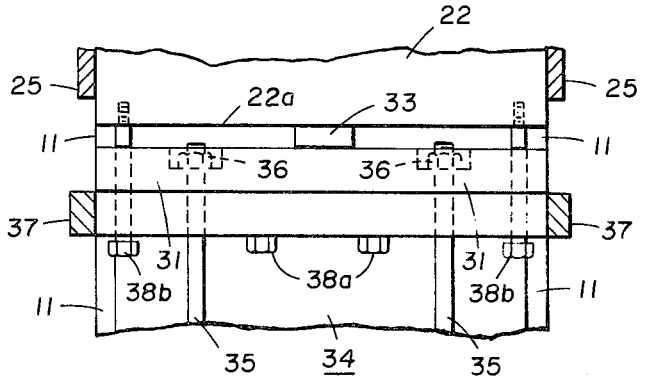
FIG. 2 is a detail view taken along the line 2—2 of FIG. 1.
Figure 3:
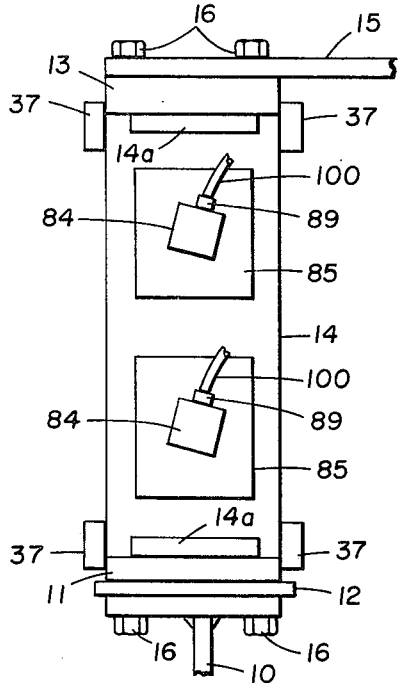
FIG. 3 is an end view taken from the line 3—3 of FIG. 1.

As shown in the drawings, FIGS. 1–3, the roll crusher is provided with a basic frame including a pair of spaced, horizontal I-beams 10 (only one being shown) suitably interconnected and braced. To the top face of each beam 10 is welded a lower slide bar 11, a plate 12 therebetween serving to stiffen both. An upper slide bar 13, partially supported on frame posts 14 (only one being shown), is disposed above each lower slide bar 11 parallel thereto, the two upper bars 13 being interconnected by cross bar 15. The latter, the upper bars 13 and the frame posts 14 are held together and to the beams 10 by bolts 16, and the frame posts 14 are further located with respect to the slide bars 11 and 13 by shear blocks **14*a* welded to the outer ends of the former. Between the two pairs of lower and upper slide bars 11 and 13 are rigidly secured two bearing blocks 17 (only one being shown) in which the fixed crushing roll 18 is journaled at 19. Laterally spaced from the fixed bearing blocks 17, by means of spacer blocks 20 (only one being shown) secured by bolts 21 to the beams 10 and upper slide bars 13, are the movable bearing blocks 22 (only one being shown) in which the movable roll 23 is journaled at 24. The movable bearing blocks 22 are slidable along and between the lower and upper slide bars 11 and 13 to adjust the spacing between the rolls 18 and 23, and are retained therebetween by means of ears 25 at the respective corners of the blocks 22 which overlap the vertical faces of the slide bars 11 and 13. The desired spacing of the rolls 18 and 23 is achieved by means of shim packs 26 disposed between the spacer blocks 20 and the adjacent faces of the bearing blocks 22. Against the opposite faces 22*a* of the latter bear the modified gas hydraulic spring assemblies, generally indicated at 30, of the present invention. It is understood, of course, that two such assemblies 30, one for each bearing block 22**, are employed though only one is illustrated and will now be described.

A pair of spaced, vertical mounted plates 31 and 32 are disposed between the slide bars 11 and 13, their lower ends sitting on the former bar with one face of the plate 31 having a centrally disposed, vertical rib 33 (see FIGS. 1, 2 and 4) seating against the bearing block face **22*a*. Between the plates 31 and 32 are disposed a pair of cylinder assemblies 34 which are secured by and carried within two pairs of cradles, each formed by a cluster of four tie rods 35 connecting the plates 31 and 32 and bolted at 36, the bolts 36 at the plate 31 seating in counterbores in the latter (see FIGS. 1 and 2). The axes of the cylinder assemblies 34 are disposed parallel to and equally to each side of, as well as in a vertical plane through, the resultant line of thrust between the post 14 and the bearing block 22. The spring assembly 30, comprising the plates 31 and 32 and the two cylinder assemblies 34, thus forms a unitary structure which is movable on the slide bars 11 and 13 back and forth between the frame posts 14 and bearing block 22, being retained between the bars 11 and 13** by four guide plates 37 removably bolted across the four ends of the plates 31 and 32 by bolts 38*a*, the plates 37 having ears at their outer ends which engage the side edges of the bars 11 and 13. Two pairs of additional bolts 38*b* also extend through the plate 31 and its two guide plates 37 and are threaded into the block face 22*a*, being shouldered at the face 22*a* in order to provide a slight amount of "play" between the bolt heads and the plates 37 (see FIG. 2) for purposes to be described.

Each cylinder assembly 34 (see FIG. 4) consists of a hollow, seamless cylinder 40 of an appropriate alloy steel internally threaded at its ends into which are screwed end caps 41 and 42 machined or cast from similar material. The latter are locked to the cylinder 40 by ball and set screw assemblies 43 and are sealed by means of appropriate O-ring, with Teflon backup ring, static seal assemblies generally indicated at 44. The inner face of the cap 41 is dished at 45, while its outer face is slightly crowned and bears against the mounting plate 31. The top of the end cap 41 is provided with an appropriate gas filler valve 46, surrounded by a protective cap 47, which opens through a passage 48 into the adjacent end of the cylinder 40. The inner face of the other end cap 42 is annularly dished at 49 and its top is provided with a hydraulic fluid quick release fitting 50 which opens through an angular passage 51 into the annular dish 49. In fact, though only one is shown, several such passages 51, circumferentially spaced about the cap 42, are provided so that the fitting 50 can always be within about 60 degrees of the gas valve 46 when the cap 42 is screwed into the cylinder 40, the unused passages 51 being plugged. The end cap 42 is axially bored to receive a piston rod 52, having an outer headed end 52*a*, which extends through an outer boss 53 on the cap 42 within an enlarged opening 54 in the mounting plate 32 against which the outer face of the cap 42 bears. The piston rod 52 is slidably sealed to the cap 42 by suitable means suh as an arrangement of O-ring, with Teflon backup ring, seal assemblies, felt wick and wiper seals and wear ring, all collectively indicated at 55. Two (only one being shown) lubricant ports 56, circumferentially spaced about the cap 42, extend radially into the piston rod 52. Both are threaded at their outer ends but only one receives an appropriate grease zerk (not shown), the other being plugged. The inner end of the piston rod 52 is shouldered and threadedly receives a main piston 60 which is locked and sealed to the rod 52 by a suitable ball and set screw assembly 61 and static seal 62, and slidably sealed in turn with respect to the cylinder 40 by an appropriate assembly of O-ring and felt wick seals collectively indicated at 63. The far end of the piston 60 is dished at 64 and between the latter and the end cap 41 is disposed a cup-shaped floating piston 65, its peripheral wall being provided with a circumferential recess 66 to each side of which are located quadring and Teflon seal assemblies 67. A pair of inclined passages 68 connects the recess 66 with the outer face of the end wall of the piston 65 which is also recessed at 69 opposite the inner end of the piston rod 52.

Figure 5:
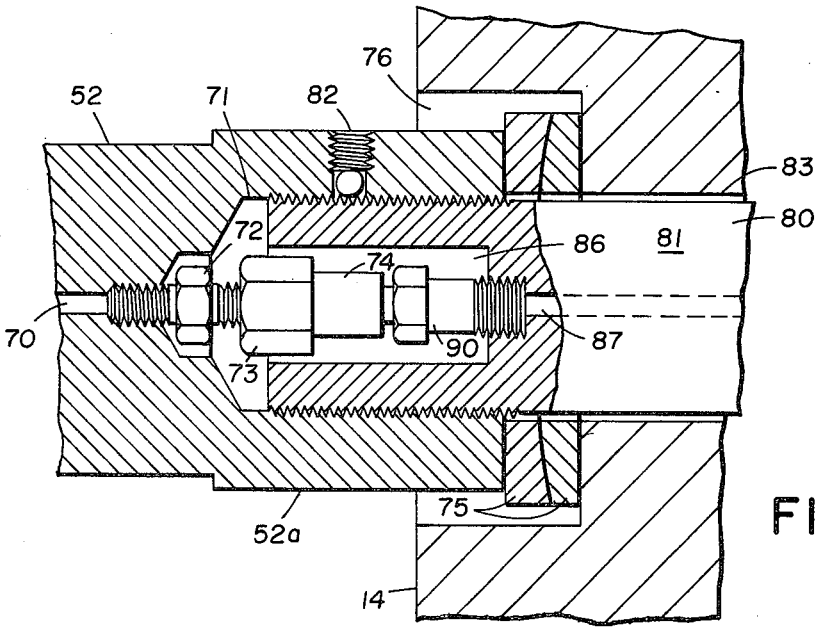
FIG. 5 is a further sectional view of a portion of FIG. 4 showing the details of one of the hydraulic connections involved.
Figure 4:
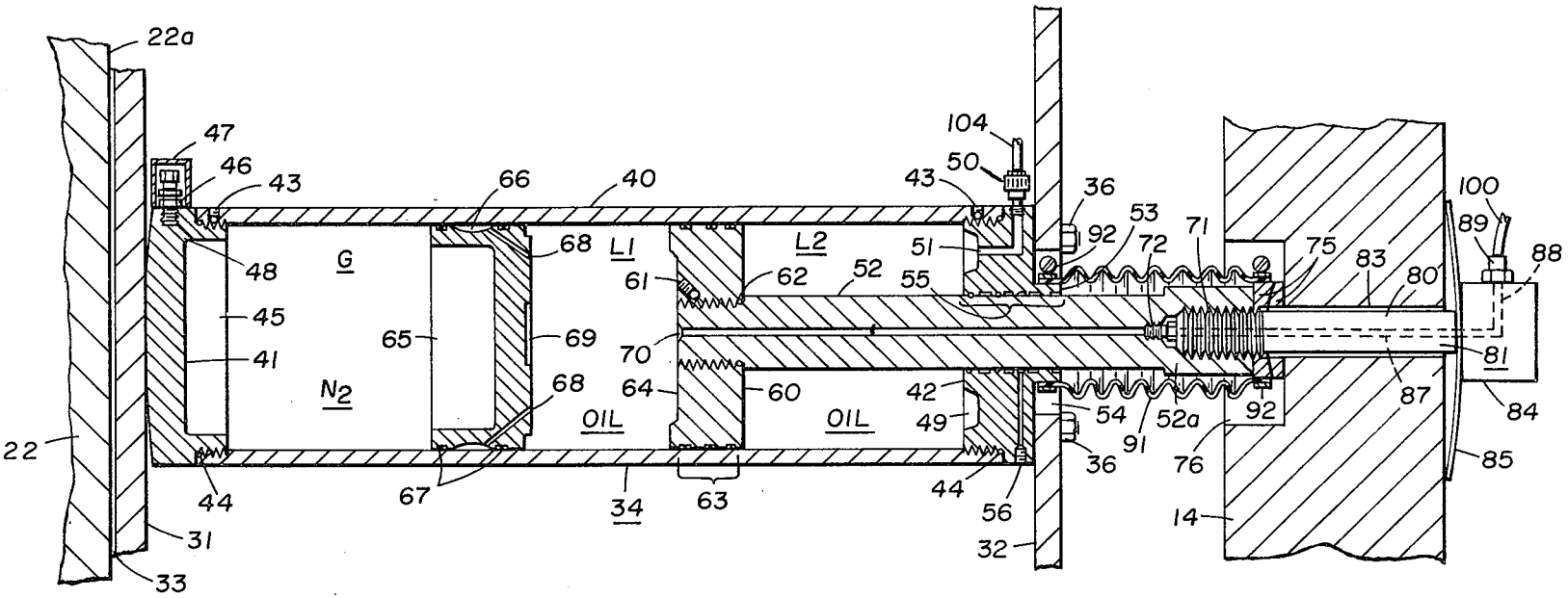
FIG. 4 is an axially sectioned view of one of the gas hydraulic cylinders of FIG. 1 illustrating its internal structure and attachment to the crusher.

The piston rod 52 is rifle drilled to provide a passage 70 which opens into an internally threaded counterbore 71 in the piston rod head 52*a* (see FIGS. 4 and 5). The outer end of the passage 70 within the counterbore 71 receives a hydraulic fitting 72 on which is screwed another fitting 73 whose other end constitutes the male half 74 of a compression type, quick release hydraulic coupling. The outer end of the piston rod head 52*a* butts against a pair of spherical washers 75 located in an enlarged recess 76 in the opposing face of the frame post 14. Into the counterbore 71 through the washers 75 is threaded the inner end of the shank 80 of an adapter 81 which is locked by an appropriate ball and set screw assembly 82 and extends through and is spacedly encompassed by a bore 83 in the post 14. The outer end of the shank 80 is provided with a square head 84 between which and the post 14 is resiliently interposed a Belleville type washer 85 of heat treated spring steel, the latter thus acting to minimize chatter between the post 14 and the adapter 81. The inner end of the shank 80 is also counterbored at 86 and then rifle drilled the remainder of its length to provide a passage 87 which intersects a passage 88 drilled inwardly from one side of the head 84 whose outer end is provided with a suitable quick release hydraulic fitting 89. Within the counterbore 86 the end of the passage 87 is provided with the female half 90 of a compression type, quick release hydraulic coupling which receives the male half 74 at the adjacent end of the piston rod passage 70. Over and between the adjacent end cap boss 53 and the washers 75 is stretched a dust bellows boot 91 which is retained by clamps 92.

The chamber G in each cylinder 40 between the end cap 41 and the floating piston 65 is designed to be pressurized with an appropriate inert gas such as nitrogen, while the two chambers L1 and L2 on the opposite ends of the main piston 60 are designed to be filled with a suitable hydraulic oil. Before its installation, each cylinder assembly 34 is stood upright on its end cap 41 and the chambers L1 and L2 in that order filled with oil and purged of air at the same time through the fittings 50 and 89 and the passages 51, 70, 87 and 88 so that the piston rod head 52*a* is bottomed against the end cap boss 53, as a result of which the floating piston 65 in turn is bottomed against the end cap 41. Then the cylinder assembly 34 is laid on its side with the filler valve 46 uppermost. The chamber G is then filled with gas through the valve 46 and passage 48 up to about 25 psig and discharged several times to flush the chamber G of as much air as possible; preferably the gas content relative to that of air should be in excess of 90 percent. The cylinder assemblies 34 are thereafter secured to the mounting plates 31 and 32 with the tie rods 35 and each spring assembly 30 as a unit installed on the crusher by lifting it into position between the slide bars 11 and 13 and the frame posts 14 and bearing blocks 22 after the movable roll 23 has been moved forward against the shim packs 26. The guide plates 37 are then installed upon the mounting plates 31 and 32 by the bolts 38*a*, and the plates 31 secured to the bearing block faces 22*a* by the shoulder bolts 38*b*.

Figure 6:
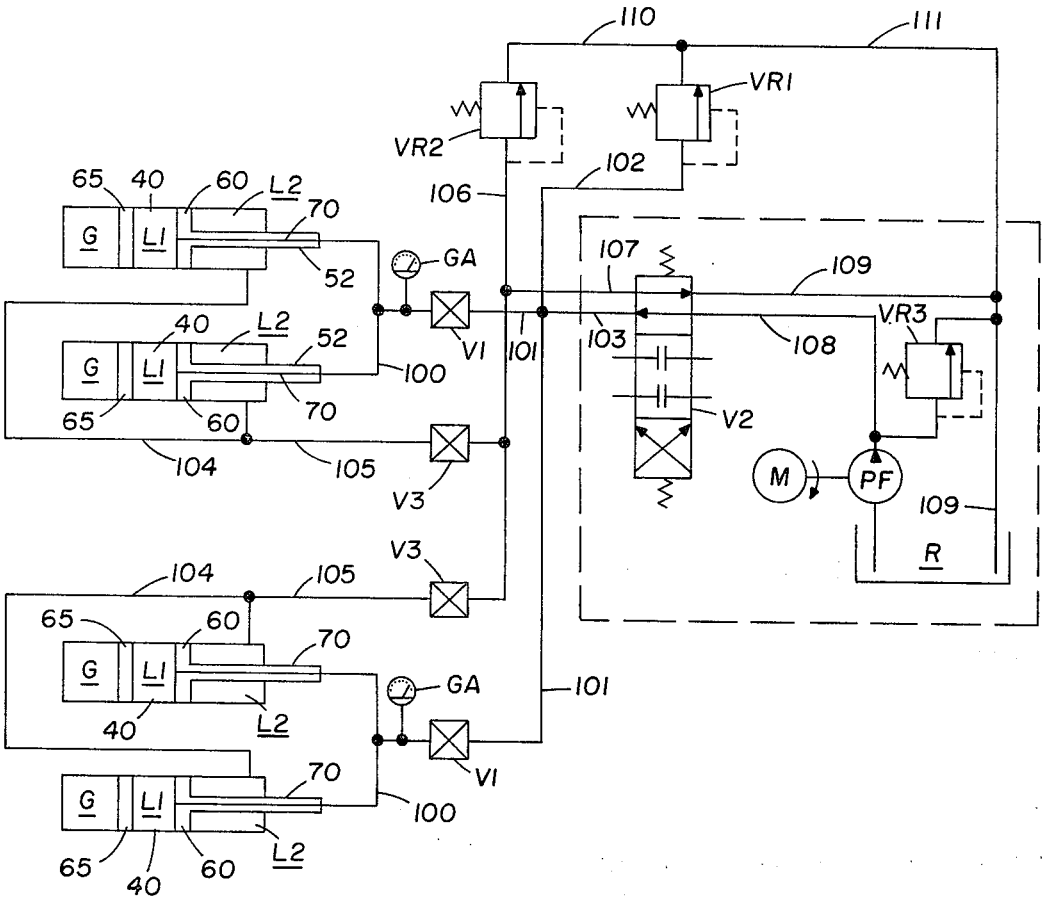
FIG. 6 is a schematic illustrating the hydraulic system for the present invention.

The spring assemblies 30 are next connected to a hydraulic system which will now be described with reference particularly to FIG. 6. The two quick release fittings 89 on each side of the crusher leading to the chambers L1 through the passage 70, 87 and 88 are interconnected by flexible hydraulic hoses 100. The latter in turn are connected by conduits 101 through pressure gauges GA and shut-off valves V1 to a pressure relief valve VR1 through a conduit 102 and to a three-position shuttle valve V2 through a conduit 103. In like manner, the two quick release fittings 50 on each side leading to the chambers L2 through the passages 51 are interconnected by flexible hoses 104 and thence by conduits 105 through shut-off valves V3 to a pressure relief valve VR2 through a conduit 106 and to the shuttle valve V2 by a conduit 107. The valve V2 in turn is connected by conduit 108 to the output of a motor driven pump PF drawing from a hydraulic fluid reservoir R to which the valve V2 is also directly connected by a conduit 109, an additional pressure relief valve VR3 interconnecting the conduits 108 and 109. The relief valves VR1 and VR2 are also connected to the conduit 109 and thus to the reservoir R by conduits 110 and 111.

Since the overall length of the spring assemblies 30 is then at its minimum, the valves V3 are opened, whence the gas pressure in the chambers G expels oil from the chambers L2 through the hoses 104, conduits 105, and 107, the valve V2 and the conduit 109 to the reservoir R. The spring assemblies 30 are thereby lengthened, the piston rod heads 52*a* moving back towards the posts 14 so that the washers 75, adapters 81, spring washers 85 and boots 91 can be installed and the adapters 81 tightened to secure the hydraulic connections 74 and 90 between the piston rods 52 and the adapters 81, the piston rods 52 thus being snugly retained against any appreciable axial movement relative to the posts 14. Then the chambers G are further filled with gas up to about ⅔ or so of the design full load pressure of the crusher. The pump PF is started, the valves V1 opened and the valve V2 shifted to its alternate flow position, whereby oil is added to the chambers L2 through conduit 108, valve V2, conduits 107 and 105, the open valves V3 and the hoses 104 at the same time as oil is expelled from the chambers L1 through the hoses 100, the open valves V1, the conduits 101 and 103, the valve V2 and the conduit 109 to the reservoir R. The roll 23 is thereby moved away from the roll 18 so that the spacing of the two can be adjusted by the shim packs 26. Finally, the valve V2 is moved to the position shown in FIG. 6, and oil added to the chambers L1 and expelled from the chambers L2 to move the roll 23 tight against the shim packs 26. Then the valves V3 are closed and oil added to the chambers L1 only, forcing the floating pistons 65 further toward the end caps 41 until the gas pressure in the chambers G is brought up to the design full load pressure of the crusher which may be 1,500 psig to 2,500 psig depending upon the size of the crusher involved, that pressure being indicated by the gauges GA since the oil pressure in chambers L1 on one side of the floating pistons 65 is equal to the gas pressure on the other side. Finally, the valve V2 is shifted to its mid position, the pump PF turned off and the crusher is then ready for operation.

In the event of an overload condition between the rolls 18 and 23, the bearing blocks 22, plates 31 and 32 and cylinders 40 move resiliently back relative to the pistons 60 and 65 toward the frame posts 14 against the gas pressure in the chambers G, the pistons 60 and 65 also remaining stationary relative to each other owing to the oil in the chambers L1 and L2, until the overload passes, whence the gas pressure restores the roll 23 to position. Care must be taken to see that the length of the cylinders 40 and the amount of gas in the chambers G are both sufficient so that there is no contact between the end cap 41 and the floating pistons 65 in the event of an overload. When the spacing between the rolls 18 and 23 is to be adjusted, or should they become locked up on account of tramp iron between them, the pump PF is started and the valve V2 shifted to its alternate flow position, whence the gas pressure on the floating pistons 65 will force oil from the chamber L1 through the hoses 100 and conduits 101, 103 and 109 to the reservoir R at the same time the pump PF is adding oil to the chambers L2 through the hoses 104 and conduits 105, 107 and 108, thus decreasing the overall length of the spring assemblies 30, whereby the bearing blocks 22, plates 31 and 32 and cylinders 40 will be moved toward the frame posts 14 to release the shim packs 26 so that adjustment can be made or the tramp iron removed, as the case may be. Then the valve V2 is shifted to the position shown in FIG. 6 and oil returned to the chambers L1 and removed from the chambers L2 to restore the crusher for further operation, all as previously explained. Normally, the valves V1 and V3 are left open at all times so that the pressure relief valves VR1 and VR2 are available to relieve the system in the event of some extraordinary overload condition. Otherwise, the valves V1 and V3 are used when it is desired to adjust the spacing at one end of the roll independently of that at the other, in which case the latter end can be isolated by closing its valves V1 and V3 while leaving those of the former end open. It will be appreciated, of course, that the lengths of the cylinders 40 and the piston rods 52 must also be sufficient so that the distance between the end caps 42 and the main pistons 60 can accommodate the minimum as well as the maximum roll setting.

Any misalignments of the parts or deflections of the spring assemblies 30 during crusher operation or adjustment is compensated for, at one end by the rib 33 between the bearing block face 22*a* and the plate 31 and the "play" between the ears 37 and shoulder bolts 38*a*, and the other end by the swivel-like joints provided by the spherical washers 75 and spring washers 85. Each spring assembly 30 can also be removed as a unit from the crusher for any reason without discharging the gas from the chambers G. All that is necessary is first to disconnect the plates 31 from the bearing blocks 22, retract the piston rods 52 with the valve V2, disconnect the hoses 100 and 104 leaving the cylinders 40 full of gas and oil, remove the adapters 81, reverse the remainder of the installation procedure previously set forth, and finally lift the spring assemblies 30 from the crusher.

While each spring assembly 30 has been shown and described as employing a pair of cylinder assemblies 34, it will be understood that only one of the latter may be necessary in the case of smaller crushers and would, of course, be located with its axis in the resultant line of thrust between the frame post 14 and the bearing block 22. Likewise, though the spring assemblies 30 are shown as applied to a two roll crusher, they are also equally applicable to three roll crushers, as will be apparent to those skilled in the art. In any event, while the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

We claim:

1. In a crusher of the roll type having a crushing roll mounted on and movable with respect to a crusher frame and a pair of gas hydraulic spring assemblies for maintaining the location of the roll with respect to the frame during crushing operation up to a predetermined crushing load, each spring assembly including at least one cylinder assembly comprising a cylinder closed at its opposite ends by first and second end walls, a floating piston slidably disposed in the cylinder and normally spaced from the first cylinder end wall, a compressible fluid pressurizing the space between the floating piston and the first cylinder end wall, a main piston slidably disposed between the floating piston and the second cylinder end wall and defining first and second chambers on the respective opposite ends of the main piston between the floating piston and the second cylinder end wall, a piston rod connected to the main piston having its outer end extending through and beyond the second cylinder end wall, the improvement comprising: means for adjusting the location of the movable roll relative to the frame by varying the overall length of each of the spring assemblies independently of the compressible fluid, said means in the case of each spring assembly including a non-compressible fluid normally filling each of the cylinder first and second chambers, and a hydraulic system for optionally and conjointly varying the volume of the non-compressible fluid in each of the two chambers effective to cause relative movement between the main piston and the cylinder and for optionally varying the volume of the non-compressible fluid in the first chamber only effective to vary the pressure of the compressible fluid between the floating piston and the first cylinder end wall, the first cylinder end wall being operatively secured to either the adjacent end of the movable roll or the frame and the outer end of the piston rod to the other thereof so that thrust upon the roll during crusher operation is transmitted to the compressible and non-compressible fluids, the non-compressible fluid and the pressure of the compressible fluid in the spring assemblies together being effective to maintain the location of the movable roll with respect to the frame up to said predetermined crushing load.

2. The crusher of claim 1 wherein there is no fluid interconnection between the compressible fluid in one of the spring assemblies and that in the other spring assembly, each of the gas hydraulic spring assemblies being self-contained and removable from the crusher without need first to dishcarge the compressible fluid therefrom.

3. The crusher of claim 1 wherein the hydraulic system comprises a non-compressible fluid source including a pump, a pair of fluid conduits interconnecting respective ones of said chambers and said fluid source, and valve means controlling flow of the non-compressible fluid between said fluid source and said chambers.

4. The crusher of claim 3 wherein said fluid source also includes a fluid reservoir supplying the pump, and wherein the valve means includes a first valve alternately connecting respective ones of the fluid conduits to the pump and the reservoir.

5. The crusher of claim 4 wherein the valve means includes second valves interposed in respective ones of the fluid conduits between the first valve and said chambers.

6. The crusher of claim 3 wherein each end of the movable roll includes a bearing block in which the roll is journaled for rotation, each bearing block having a face disposed in spaced relation to a frame member and slidable on the frame so that said face thereof is urged toward the frame member in response to thrust upon the movable roll during operation of the crusher, each spring assembly being operatively interposed between one of said faces and frame members and comprising at least one cylinder assembly having its cylinder disposed between and carried by a pair of first and second mounting plates respectively connected to the first and second cylinder end walls and movable on and relative to the frame, the first mounting plate being operatively secured to said block face to move with the block and the outer end of the connecting rod of the cylinder assembly being secured relative to the frame member against axial movement with respect thereto, whereby the bearing block, the mounting plates and the cylinder are thereby movable as a unit relative to the frame toward or away from the frame member when the volume of the fluid in the first chamber is respectively reduced or increased and that in the second chamber conjointly respectively increased or reduced by the adjusting means.

7. The crusher of claim 6 wherein each of the spring assemblies includes two of the cylinder assemblies, the axes of their cylinder being disposed parallel to each other between the mounting plates and on opposite sides of and in a plane through the resultant line of thrust between said block face and frame member during operation of the crusher.

8. The crusher of claim 6 wherein the connection of each piston rod to the frame member is effective to accommodate angular deflections of the spring assemblies relative to the frame members during crushing operation.

9. The crusher of claim 8 wherein one of the fluid conduits is connected to the first chamber through a passageway extending longitudinally in the piston rod and the other of the fluid conduits is connected to the second chamber through a passageway opening thereinto through the second cylinder end wall.

10. The crusher of claim 9 wherein the outer end of each piston rod is seated in an enlarged recess in the frame member and is provided with means forming a swivel-like joint between said recess and rod end, said rod end having a threaded counterbore therein communicating with the passageway in the connecting rod, and including a piston rod anchor member having a shank with an inner end removably threadedly engaging said counterbore, the shank extending through a bore in the frame member spacedly encompassing the shank, the outer end of the shank being provided with a retaining head disposed at an opposite side of the frame member and means forming a swivel-like joint between said head and opposite side, whereby the piston rod is secured as aforesaid and can accommodate said deflections, the shank having a fluid passage therethrough with its inner end in releasable sealing communication in said counterbore with the connecting rod fluid passageway and its outer end opening through the retaining head for connection to said fluid conduit.

* * * * *